US010464186B2

(12) United States Patent
Shibuya et al.

(10) Patent No.: US 10,464,186 B2
(45) Date of Patent: Nov. 5, 2019

(54) METHOD OF POLISHING WORK AND METHOD OF DRESSING POLISHING PAD

(71) Applicants: Fujikoshi Machinery Corp., Nagano (JP); Kanazawa Institute of Technology, Ishikawa (JP)

(72) Inventors: Kazutaka Shibuya, Nagano (JP); Jun Yanagisawa, Nagano (JP); Yoshio Nakamura, Nagano (JP); Michio Uneda, Ishikawa (JP); Kenichi Ishikawa, Ishikawa (JP)

(73) Assignees: FUJIKOSHI MACHINERY CORP., Nagano (JP); KANAZAWA INSTITUTE OF TECHNOLOGY, Ishikawa (JP)

( * ) Notice: Subject to any disclaimer, the term of this patent is extended or adjusted under 35 U.S.C. 154(b) by 159 days.

(21) Appl. No.: 15/394,274

(22) Filed: Dec. 29, 2016

(65) Prior Publication Data

US 2017/0190018 A1 Jul. 6, 2017

(30) Foreign Application Priority Data

Jan. 5, 2016 (JP) ..... 2016-000556

(51) Int. Cl.

| | |
|---|---|
| ***B24B 49/18*** | (2006.01) |
| ***B24B 37/005*** | (2012.01) |
| ***B24B 53/007*** | (2006.01) |
| ***B24B 53/017*** | (2012.01) |
| ***B24B 37/20*** | (2012.01) |

(Continued)

(52) U.S. Cl.

CPC ..... *B24B 37/20* (2013.01); *B24B 37/005* (2013.01); *B24B 37/042* (2013.01); *B24B 49/18* (2013.01); *B24B 53/007* (2013.01); *B24B 53/017* (2013.01); *B24B 53/06* (2013.01); *B24B 53/08* (2013.01)

(58) Field of Classification Search

CPC ..... B24B 37/005; B24B 37/042; B24B 49/18; B24B 53/007; B24B 53/017; B24B 53/02

USPC ..... 451/5, 56, 443

See application file for complete search history.

(56) References Cited

U.S. PATENT DOCUMENTS 5,708,506 A * 1/1998 Birang ..... B24B 49/12 356/600
6,004,196 A * 12/1999 Doan ..... B24D 7/18 451/287

(Continued)

FOREIGN PATENT DOCUMENTS

JP 2001260001 9/2001
JP 5366041 12/2013
JP WO 2016111335 A1 * 7/2016 ..... B24B 37/00

*Primary Examiner* — Eileen P Morgan
(74) *Attorney, Agent, or Firm* — Stephen J. Weyer, Esq.; Stites & Harbison, PLLC

(57) ABSTRACT

The method of the present invention comprises the steps of: previously obtaining correlation data between surface properties of the polishing pad dressed under a plurality of stages of dressing conditions and polishing effects of the work polished by the polishing pad dressed under the dressing conditions; determining an assumed dressing condition capable of achieving an object polishing effect from the correlation data; dressing the polishing pad under the assumed dressing condition determined; polishing the work; cleaning the polishing pad which has been used for polishing the work; and measuring a surface property of the cleaned polishing pad.

6 Claims, 9 Drawing Sheets

(51) Int. Cl.

| | |
|---|---|
| ***B24B 37/04*** | (2012.01) |
| ***B24B 53/06*** | (2006.01) |
| ***B24B 53/08*** | (2006.01) |

(56) References Cited

U.S. PATENT DOCUMENTS 6,102,776 A * 8/2000 Boggs ..... B24B 37/013 451/285
6,684,704 B1 * 2/2004 Obeng ..... B24B 37/005 451/21
6,910,947 B2 * 6/2005 Paik ..... B24B 37/013 451/21
7,018,269 B2 * 3/2006 Anderson ..... B24B 21/04 257/E21.23
7,020,306 B2 * 3/2006 Hirose ..... B24B 37/20 382/108
7,762,871 B2 * 7/2010 Bajaj ..... B23K 26/0066 219/121.6
7,846,008 B2 * 12/2010 Bajaj ..... B24B 37/26 451/527
8,075,745 B2 * 12/2011 Bajaj ..... B23H 5/08 204/224 M
8,398,463 B2 * 3/2013 Bajaj ..... B23K 26/0075 451/28
8,932,883 B2 * 1/2015 Matsuo ..... G01N 21/4738 438/16
9,731,401 B2 * 8/2017 Maruyama ..... B24B 53/017
9,835,449 B2 * 12/2017 Cho ..... G01B 11/303
2001/0012751 A1 * 8/2001 Boyd ..... B24B 37/042 451/41
2002/0063860 A1 * 5/2002 Jun ..... B24B 37/013 356/237.2
2006/0172662 A1 * 8/2006 Lim ..... B24B 49/003 451/5
2014/0262027 A1 * 9/2014 Matsuo ..... G01B 11/303 156/345.13
2016/0184960 A1 * 6/2016 Matsuo ..... B24B 37/005 451/5
2018/0015590 A1 * 1/2018 Matsuo ..... B24B 37/00

* cited by examiner (a) #80

(b) #500

(c) #1000

METHOD OF POLISHING WORK AND METHOD OF DRESSING POLISHING PAD

CROSS-REFERENCE TO RELATED APPLICATION

This application is based upon and claims the benefit of priority of the prior Japanese Patent Application No. 2016-000556, filed on Jan. 5, 2016, and the entire contents of which are incorporated herein by reference.

FIELD

The present invention relates to a method of polishing a work, e.g., wafer, and a method of dressing a polishing pad.

BACKGROUND

Polishing a work, e.g., wafer, is performed by pressing a surface of the work to be polished onto a surface of a polishing pad adhered on a polishing plate and rotating the polishing plate with supplying a polishing liquid to the polishing pad.

However, clogging the polishing pad gradually occurs by performing the polishing many times, and a polishing rate will be lowered. Thus, the surface of the polishing pad is dressed, by a dressing grindstone, every time after performing the polishing prescribed times (see Patent Document 1).

Patent Document 1 discloses a method of flattening a semiconductor device, in which a dressing condition is controlled. The method is performed in an apparatus comprising: a dressing rate measuring unit for detecting a dressing rate of a polishing pad, which is varied with a progress of the polishing; and a surface property measuring unit for measuring a surface property of the polishing pad. The data automatically measured are used to maintain the dressing rate, which significantly influences on a scratch density, within prescribed management values.

In Patent Document 1, the method of measuring the surface property of the polishing pad is performed by an image processing manner or a reflectance manner. Namely, the image processing manner is performed by the steps of: lighting the surface of the polishing pad by a light emitting unit; producing an image of the lighted part by a CCD camera; and processing the image so as to calculate an area ratio of a flat part formed by the clogging. The reflectance manner is performed by the steps of: emitting a laser beam toward the surface of the polishing pad; receiving the reflected beam; and measuring the surface property of the polishing pad on the basis variation of light quantity of the received beam.

PRIOR ART DOCUMENT

Patent Document 1: Japanese Laid-open Patent Publication No. 2001-260001

SUMMARY

By the invention disclosed in Patent Document 1, the surface property of the polishing pad is measured and the dressing is performed while polishing the work, so that the dressing is controlled in response to the surface property of the polishing pad which changes every moment.

However, in Patent Document 1, the surface property of the polishing pad is measured while polishing the work, so an image which differs from the actual image will be captured or an unclear image will be captured due to polishing dusts and a polishing liquid (e.g., cloudy liquid).

The present invention is invented to solve the above described problem, and an object of the present invention is to provide a method of polishing a work and a method of dressing a polishing pad, in each of which a surface property of the polishing pad can be correctly detected, high accurate dressing can be performed and a work can be accurately polished.

To achieve the objects, the present invention has following structures.

Namely, the polishing method of the present invention comprises the steps of:

pressing a work onto a polishing pad of a rotating polishing plate;

polishing a surface of the work with supplying a polishing liquid to the polishing pad; and reciprocally moving a dressing head, which has a dressing grindstone, on the polishing pad so as to dress a surface of the polishing pad with the dressing grindstone after the polishing step, the method is characterized by the steps of:

previously obtaining correlation data between surface properties of the polishing pad dressed under a plurality of stages of dressing conditions and polishing effects of the work polished by the polishing pad dressed under the dressing conditions;

determining an assumed dressing condition capable of achieving an object polishing effect from the correlation data;

dressing the polishing pad under the assumed dressing condition determined;

polishing the work;

cleaning the polishing pad which has been used for polishing the work; and measuring a surface property of the cleaned polishing pad, and the method is further characterized in, that if the measured surface property of the polishing pad is within set data indicating a predetermined surface property, the step of polishing the work is performed, and that if the measured surface property of the polishing pad is inferior to the set data, the step of dressing the polishing pad under the assumed dressing condition is performed again or the polishing pad is exchanged.

The method may further comprise the steps of:

cleaning the polishing pad after redressing the polishing pad under the assumed dressing condition; and measuring the surface property of the cleaned polishing pad, and if the measured surface property of the polishing pad is inferior to the set data, the polishing pad is exchanged.

The surface property of the polishing pad can be measure by using number of contact points per unit area.

The dressing method of the present invention comprises the steps of:

pressing a work onto a polishing pad of a rotating polishing plate;

polishing a surface of the work with supplying a polishing liquid to the polishing pad; and reciprocally moving a dressing head, which has a dressing grindstone, on the polishing pad so as to dress a surface of the polishing pad with the dressing grindstone after the polishing step, the method is characterized by the steps of:

previously obtaining correlation data between surface properties of the polishing pad dressed under a plurality of stages of dressing conditions and polishing effects of the work polished by the polishing pad dressed under the dressing conditions;

determining an assumed dressing condition capable of reproducing an object polishing effect from the correlation data; and dressing the polishing pad under the assumed dressing condition determined, and the method is further characterized in, that a surface property of the polishing pad is measured, and that if the measured surface property of the polishing pad is inferior to set data indicating a predetermined surface property, the step of dressing the polishing pad under the assumed dressing condition is performed again or the polishing pad is exchanged.

The above described methods relating to the present invention are performed by the steps of: previously obtaining the correlation data between the surface properties of the polishing pad dressed under a plurality of stages of the dressing conditions and the polishing effects of the work polished by the polishing pad dressed under the dressing conditions; determining the assumed dressing condition capable of achieving the object polishing effect from the correlation data; dressing the polishing pad under the assumed dressing condition determined; polishing the work after performing the dressing step; cleaning the polishing pad which has been used for polishing the work after performing the polishing step; and measuring a surface property of the cleaned polishing pad after performing the cleaning step. Therefore, the surface property of the polishing pad can be correctly detected without being badly influenced by polishing dusts, etc., and high accurate dressing can be performed. Further, since the surface property of the polishing pad is controlled within the set data indicating the predetermined surface property, the work can be accurately polished.

A polishing state of the work is controlled on the basis of the surface property of the polishing pad, which can be easily measured, without using polishing rate of the work, so that the polishing can be easily controlled.

By obtaining the correlation data as a plurality of stages of combination data of the dressing conditions and the polishing conditions, actual dressing conditions and polishing conditions can be precisely determined, so that the surface property of the polishing pad can be excellently maintained, and the work can be precisely polished.

In case that the surface property of the polishing pad is indicated as number of contact points between the dove prism and the polishing pad in the state where the dove prism is pressed onto the polishing pad with the prescribed pressing force, number of contact points between the work and the polishing pad is not directly measured, but number of the contact points nearly equal to the directly measured number can be obtained, so that the state of the work being polished can be suitably obtained.

BRIEF DESCRIPTION OF THE DRAWINGS

Embodiments of the present invention will now be described by way of examples and with reference to the accompanying drawings which are given by way of illustration only, and thus are not limitative of the present invention, and in which.

DESCRIPTION OF THE EMBODIMENTS

Preferred embodiments of the present invention will now be described in detail with reference to the accompanying drawings.

Figure 1:
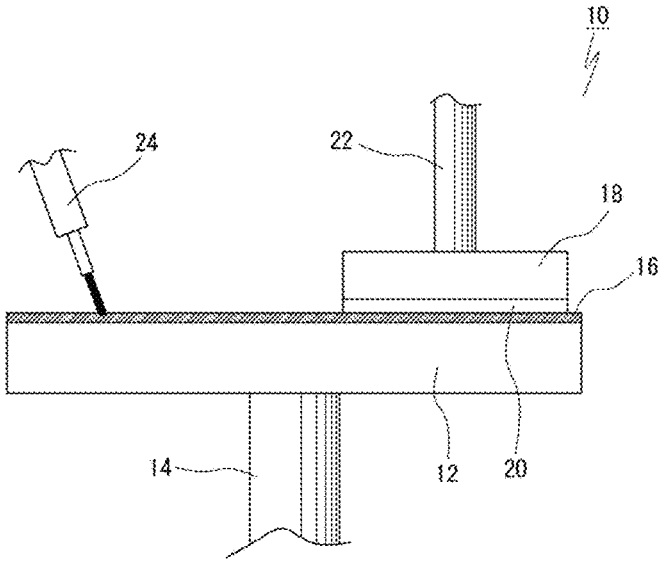
FIG. 1 is a schematic explanation view of a polishing apparatus.

FIG. 1 is a schematic explanation view of a polishing apparatus 10.

A polishing plate 12 is rotated, by a known driving mechanism (not shown), in a horizontal plane, about a rotary shaft 14. A polishing pad 16, which is mainly composed of, for example, foamed polyurethane, is adhered on an upper surface of the polishing plate 12.

A work 20 to be polished (e.g., semiconductor wafer) is held on a bottom surface of a polishing head 18. The polishing head 18 is rotated about a rotary shaft 22. The polishing head 18 can be moved upward and downward by a vertical driving mechanism (not shown), e.g., cylinder unit.

A slurry supplying nozzle 24 supplies slurry (polishing liquid) onto the polishing pad 16.

A lower surface of the work 20 is polished by steps of: holding the work 20 on the bottom surface of the polishing head 18 by surface tension of water, air suction etc.; moving the polishing head 18 downward; pressing the work 20 onto the polishing pad 16 of the polishing plate 12 rotating in a horizontal plane with a prescribed pressing force (e.g., 150 gf/cm$^2$); and rotating the polishing head 18 about the rotary shaft 22. The slurry is supplied onto the polishing pad 16 from the slurry supplying nozzle 24 while polishing the work 20.

Note that, various types of polishing heads are known, so the type of the polishing head 18 is not limited.

Figure 2:
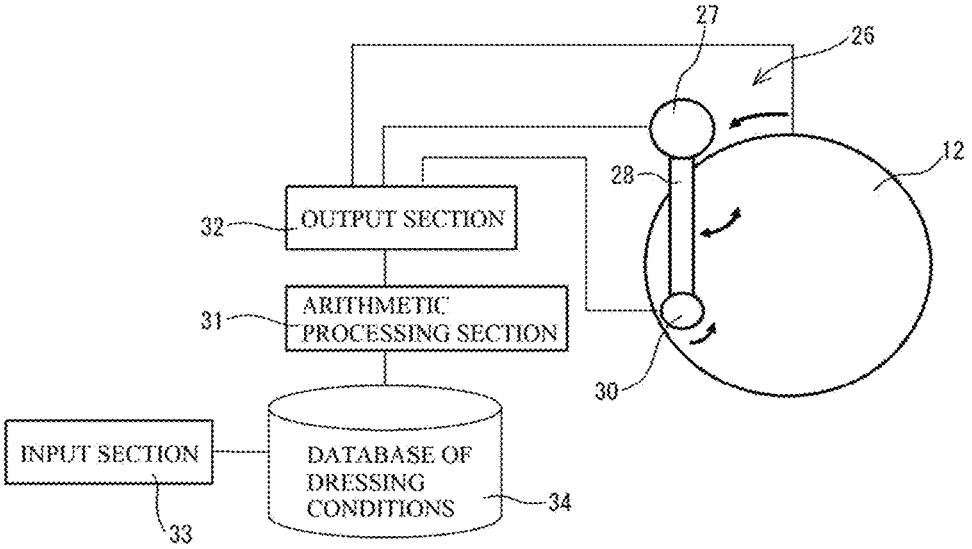
FIG. 2 is an explanation view of a dressing apparatus.

FIG. 2 is a explanation view of a dressing apparatus 26.

The dressing apparatus 26 has a swing arm 28, which can be turned about a rotary shaft 27. A dressing head 30 is fixed to a front-end part of the swing arm 28. Dressing grindstones, which include diamond particles having prescribed particle sizes, are fixed to a lower part of the dressing head 30. The dressing head 30, which is provided to the front-end part of the swing arm 28, can be rotated about own axial line.

The polishing pad 16 is dressed by steps of: actuating a output section, e.g., motor, on the basis of a command from an arithmetic processing section 31, so as to rotate the polishing plate 12; and turning the swing arm 28 about the rotary shaft 27 to reciprocally move the dressing head 30 in a radial direction of the polishing plate 12 with rotating the dressing head 30 about its own axis. Therefore, an upper surface of the polishing pad 16 is grinded by the dressing grindstones, so that the upper surface of the polishing pad 16 can be dressed. Note that, various data are inputted through an input section 33, and a data base including correlation data is stored in a storing section 34 as a database of dressing conditions.

The dressing head 30 presses the polishing pad 16 with a prescribed pressing force while dressing. Preferably, a rotational speed of the polishing plate 12 and a swing speed of the swing arm 28 are suitably controlled so as to uniformly dress the entire surface of the polishing pad 16.

A concrete example of a structure of the polishing head 30 will be explained afterwards.

Dressing the polishing pad 16 is performed after newly adhering the polishing pad or every time after performing the polishing prescribed times. Note that, in case that the polishing pad 16 is exchanged and newly adhered, this polishing pad 16 may be previously dressed in a different place as described later, and the dressed polishing pad 16 may be adhered onto the polishing plate 12. In case that the dressing is performed after polishing the work 20, the polishing pad 16 is cleaned, by a cleaning unit, so as to wash away polishing dusts and the used slurry before performing the dressing. By performing the dressing after washing away the polishing dusts and slurry, the dressing can be precisely performed.

Note that, cleaning the polishing pad 16 is performed by spraying high pressure water from a nozzle toward the polishing pad 16. An example of the cleaning unit is disclosed in Japanese Laid-open Patent Publication No. 2010-228058.

Figure 3:
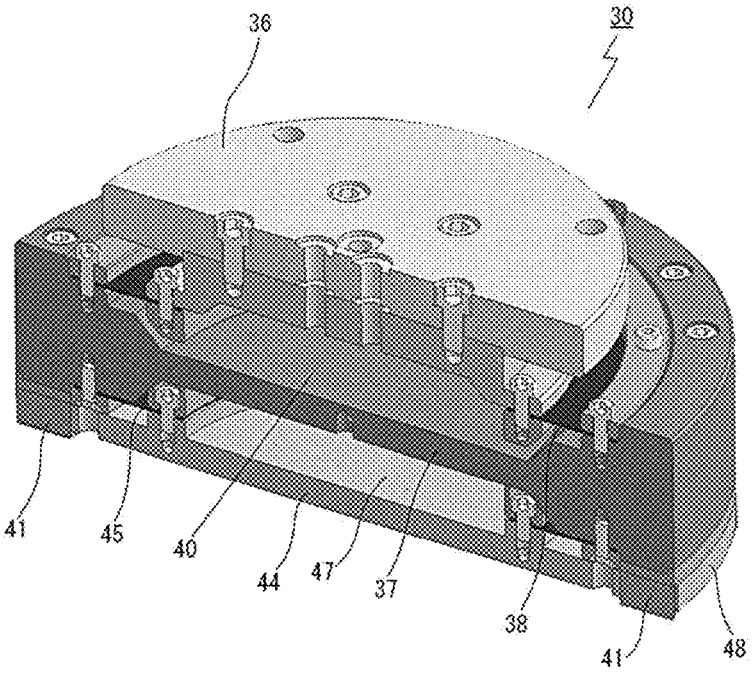
FIG. 3 is a sectional view of a dressing head.
Figure 4:
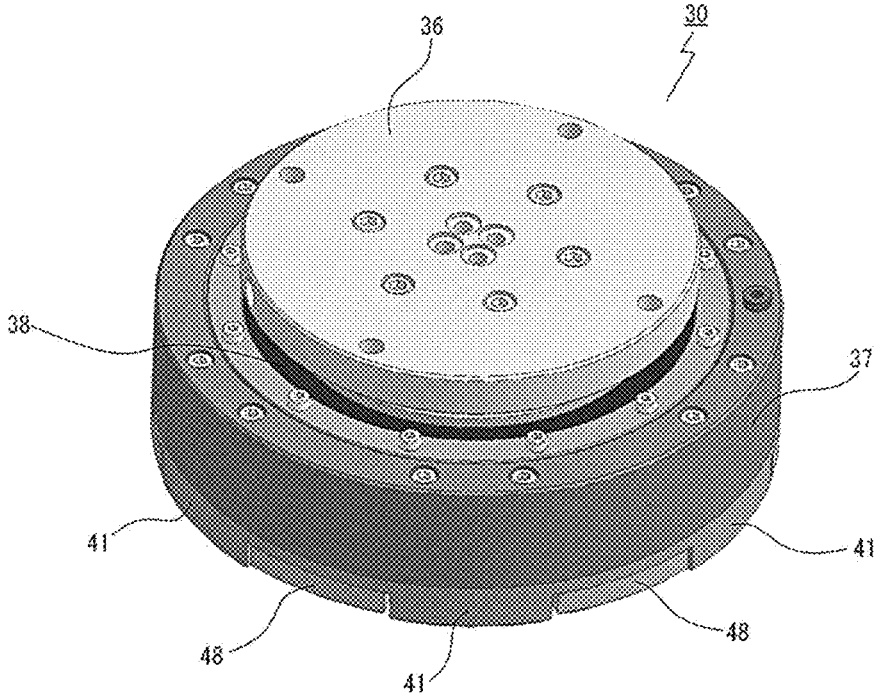
FIG. 4 is a perspective view of the dressing head.
Figure 5:
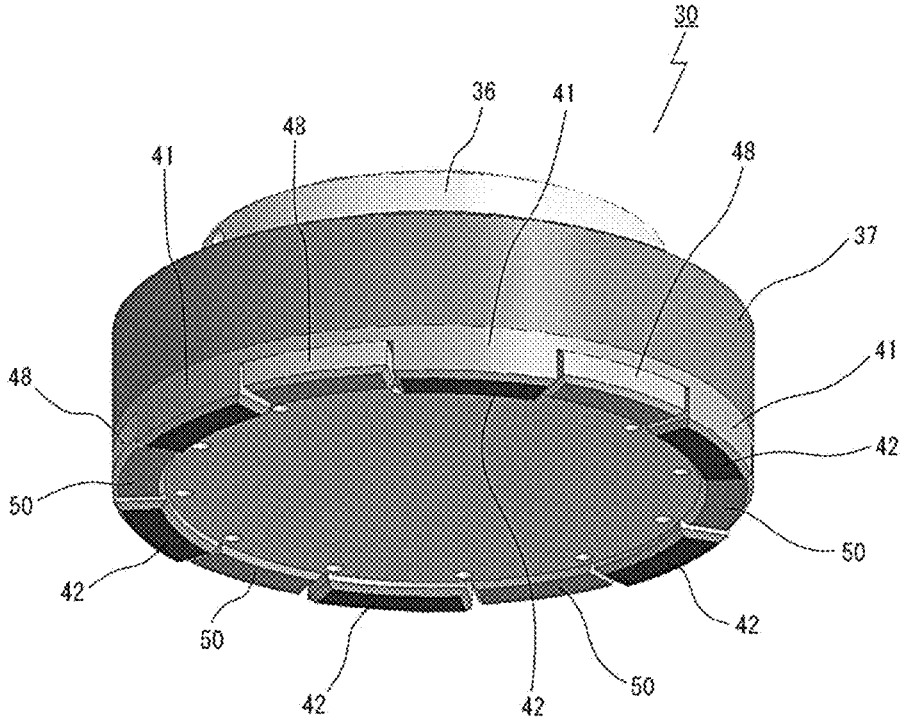
FIG. 5 is a perspective view of the dressing head seen from another angle.

An example of the dressing head 30 is shown in FIGS. 3-5.

A first movable plate 37 is attached to a head main part 36 with a flexible diaphragm 38 and capable of moving upward and downward with respect to the head main part 36.

The diaphragm 38 is formed into a ring-shape. An inner edge part of the diaphragm 38 is fixed to the head main part 36 by screws, and an outer edge part thereof is fixed to the first movable plate 37 by screws. A first pressure chamber 40 is formed between a bottom surface of the head main part 36, a bottom surface of the diaphragm 38 and an upper surface of the first movable plate 37. Pressurized air can be introduced into the first pressure chamber 40 from a pressure source (not shown) via a flow path (not shown).

A plurality of projecting sections 41 are provided in an outer edge part of the bottom surface of the first movable plate 37 and arranged in a circumferential direction at prescribed intervals. A dressing grindstone 42, to which diamond particles whose particle size is, for example, #80 are fixed, is fixed to a bottom surface of each of the projecting sections 41.

In FIG. 3, a second movable plate 44 is attached to the bottom surface of the first movable plate 37 with a flexible diaphragm 45 and capable of moving upward and downward with respect to the first movable plate 37.

The diaphragm 45 is formed into a ring-shape. An inner edge part of the diaphragm 45 is fixed to the second movable plate 44 by screws, and an outer edge part thereof is fixed to the first movable plate 37 by screws. A second pressure chamber 47 is formed between the bottom surface of the first movable plate 37, an upper surface of the diaphragm 45 and an upper surface of the second movable plate 44. Pressurized air can be introduced into the second pressure chamber 47 from the pressure source (not shown) via a flow path (not shown).

A plurality of projecting sections 48 are provided in an outer edge part of the bottom surface of the second movable plate 44 and arranged in a circumferential direction at prescribed intervals. Each of the projecting sections 48 is provided in a space between the adjacent projecting sections 41. Therefore, the projecting sections 41 and 48 are located on a same circular line. A dressing grindstone 50, to which diamond particles whose particle size is, for example, #1000 are fixed, is fixed to a bottom surface of each of the projecting sections 48.

When pressurized air is introduced into the first pressure chamber 40 and the second pressure chamber 47 via the flow paths (not shown), the dressing grindstones 42 and 50 are independently projected downward, so that the dressing grindstones 42 and 50 are pressed onto the polishing pad 16 and the polishing pad 16 can be dressed. Note that, the dressing grindstones 42 and the dressing grindstones 50 are capable of simultaneously pressing and dressing the polishing pad 16.

Note that, in the present embodiment, the dressing head 30 has two types of the dressing grindstones whose grit sizes are #80 and #1000. In some cases, a third movable plate (not shown), which is capable of moving upward and downward with respect to the second movable plate 44, may be provided as well, and a dressing grindstone, to which particles whose grit size is, for example, #500 are fixed, is fixed to a bottom surface of each of projecting sections of the third movable plate. In this case, the dressing can be performed with the dressing grindstones having three stages of grit sizes: #80, #500 and #1000.

Successively, a work polishing method of the present embodiment will be explained.

As described above, the work polishing method of the present embodiment is characterized by the steps of:

(A) previously obtaining correlation data between surface properties of the polishing pad dressed under a plurality of stages of dressing conditions and polishing effects of the work polished by the polishing pad under the dressing conditions;

(B) determining an assumed dressing condition capable of achieving an object polishing effect from the correlation data, and dressing the polishing pad under the assumed dressing condition determined;

(C) polishing the work;

(D) cleaning the polishing pad which has been used for polishing the work; and (E) measuring a surface property of the cleaned polishing pad, and (F) the method is further characterized in that if the measured surface property of the polishing pad is within set data indicating a predetermined surface property, the step of polishing the work is performed, and that if the measured surface property of the polishing pad is inferior to the set data, the step of dressing the polishing pad under the assumed dressing condition is performed again or the polishing pad is exchanged.

Concretely, the method may further comprise the steps of: cleaning the polishing pad after redressing the polishing pad under the assumed dressing condition; and measuring the surface property of the cleaned polishing pad, and if the measured surface property of the polishing pad is inferior to the set data, the polishing pad may be exchanged.

The dressing method of the present embodiment is characterized by the steps of: previously obtaining correlation data between surface properties of the polishing pad dressed under a plurality of stages of dressing conditions and polishing effects of the work polished by the polishing pad under the dressing conditions; determining an assumed dressing condition capable of reproducing an object polishing effect from the correlation data; and dressing the polishing pad under the assumed dressing condition determined, and the method is further characterized in that a surface property of the polishing pad is measured, and that if the measured surface property of the polishing pad is inferior to set data indicating a predetermined surface property, the step of dressing the polishing pad under the assumed dressing condition is performed again or the polishing pad is exchanged.

Next, a concrete example of the steps will be explained.

<Step (A) of Obtaining Correlation Data>

TABLE 1 and TABLE 2 show examples of correlation data, which indicate a correlation between surface properties of the polishing pad 16 previously dressed under a plurality of stages of dressing conditions and polishing effects of the work polished by the polishing pad 16 under the dressing conditions. Note that, in the present embodiment, three different dressing heads, which had dressing grindstones of three stages of grit sizes (e.g., #80, #500 and #1000) corresponding to the dressing conditions, were prepared. The dressing heads respectively corresponded to the dressing conditions. Further, polishing conditions were two stages of pressing forces applied to the work 20 to press the work 20 onto the polishing plate 12. The two stages of pressing forces were a low load (30 kPa) stage and a high load (90 kPa) stage.

TABLE 1

RELATIONSHIP BETWEEN POLISHING CONDITION AND GRIT SIZE OF GRINDSTONE

| POLISHING CONDITION | | DRESSING CONDITION CONDITION 2 |
|---|---|---|
| CONDITION 1 (WORK, LOAD) | POLISHING EFFECT (RATE nm/min) | GRIT SIZE OF GRINDSTONE |
| SAPPHIRE, 4 INCH, LOW LOAD (30 kPa) | 2.55 | #80 |
| | 4.77 | #500 |
| | 5.28 | #1000 |
| SAPPHIRE, 4 INCH, HIGH LOAD (90 kPa) | 68.2 | #80 |
| | 102 | #500 |
| | 155 | #1000 |

TABLE 2

RELATIONSHIP BETWEEN GRIT SIZE OF GRINDSTONE AND NUMBER OF CONTACT POINTS

| GRIT SIZE OF GRINDSTONE | NUMBER OF CONTACT POINTS 1/mm$^2$ |
|---|---|
| #80 | 19.4 |
| #500 | 28.8 |
| #1000 | 43.5 |

TABLE 1 shows polishing rates (polishing effects) of the work (sapphire wafer) 20 polished, by the polishing pad 16 which were dressed by the dressing grindstones of grit size #80, #500 and #1000 (CONDITION 2), under CONDITION 1 of the polishing conditions (i.e., two stages of the pressing forces).

TABLE 2 shows data of surface properties (e.g., number of contact points) of the polishing pad 16 dressed by the dressing grindstones of grit size #80, #500 and #1000. A manner for measuring the surface properties (number of contact points) will be explained afterwards.

In CONDITION 1 of the polishing conditions, sapphire was used, and the polishing condition may be set for each material of the work 20, e.g., Si, SiC. The pressing force (load) for polishing may be set in three stages, four stages or more. Further, a rotational speed of the polishing plate 12, a rotational speed of the polishing head 18 may be set in stages.

In the dressing condition (CONDITION 2), the particle sizes of the dressing grindstones are basic conditions, and number of stages of the particle sizes need not be three. Two stages, four stages or more may be employed. Further, a dressing time, a dressing pressure, a swing speed of the swing arm 28, the rotational speed of the dressing head, the rotational speed of the polishing plate, etc. may be set in stages.

Preferably, in case of dressing the polishing pad 16 by the dressing grindstone including small particles, e.g., grit size of #1000, the polishing pad 16 is previously dressed by using the dressing grindstone including large particles (e.g., grit size of #80), and then the polishing pad 16 is dressed by the dressing grindstone including the small particles whose grit size is #1000. By dressing the surface of the polishing pad 16 in stages from a large particle size to a small particle size so as to roughen the surface of the polishing pad 16, number of contact points can be increased and the polishing pad 16 can be effectively dressed.

Next, a method of measuring the surface property (number of contact points, etc.) of the polishing pad 16 will be explained. A method disclosed in Japanese Patent No. 5366041 can be used as the measuring method.

Figure 6:
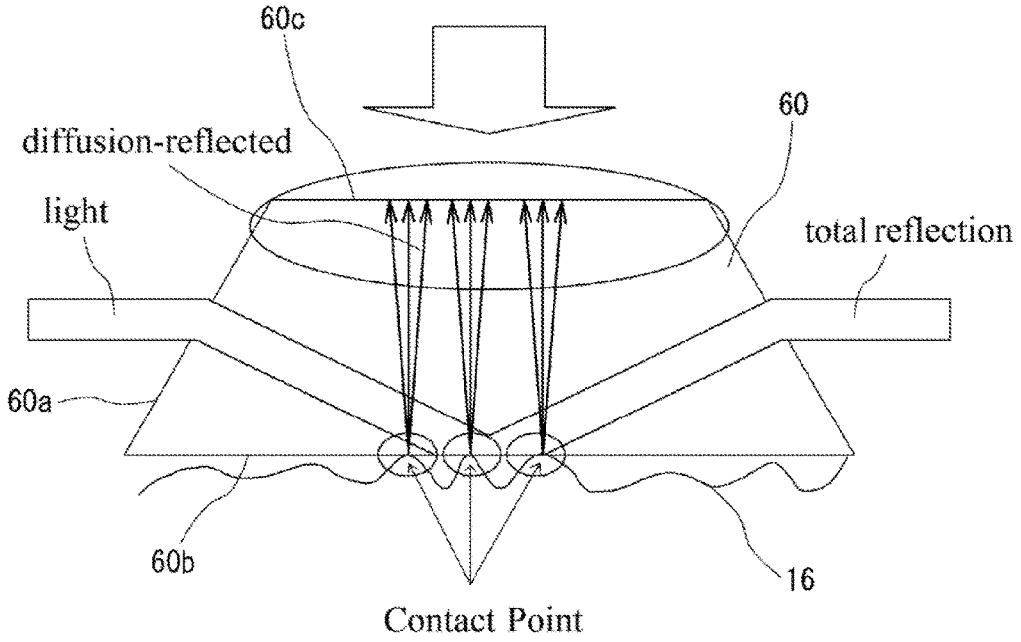
FIG. 6 is an explanation view showing a principle of a dove prism.

In the method of Japanese Patent No. 5366041, a surface property of a polishing pad is observed by using a dove prism. The prism is one of optical glasses and called "image-rotating prism". As shown in FIG. 6, in the dove prism 60, entering an incident surface 60*a* at an angle of 45 degrees is totally reflected on a bottom surface (contact surface) 60*b* of the prism 60 and transmitted outside through the prism 60. Note that, at a contact point between the contact surface and the pad 16, a condition of the total reflection of the light is broken, so the light is diffusion-reflected. On the other hand, at other points (at noncontact points), the light is totally reflected. The incident surface 60*a* has an acute angle with respect to the contact surface 60*b*. Note that, the prism need not be the dove prism formed into a trapezoid shape as shown in FIG. 6.

In the present embodiment, a contact image between the polishing pad 16 and the dove prism 60 is obtained, by receiving reflection lights which have been diffusion-reflected at contact points, by a receiving section (microscope), with applying a prescribed pressing force to the polishing pad 16 through the dove prism 60.

The microscope is capable of obtaining an image in an area of 7.3 mm×5.5 mm as the image of 1600 pixels×1200 pixels.

Figure 7:
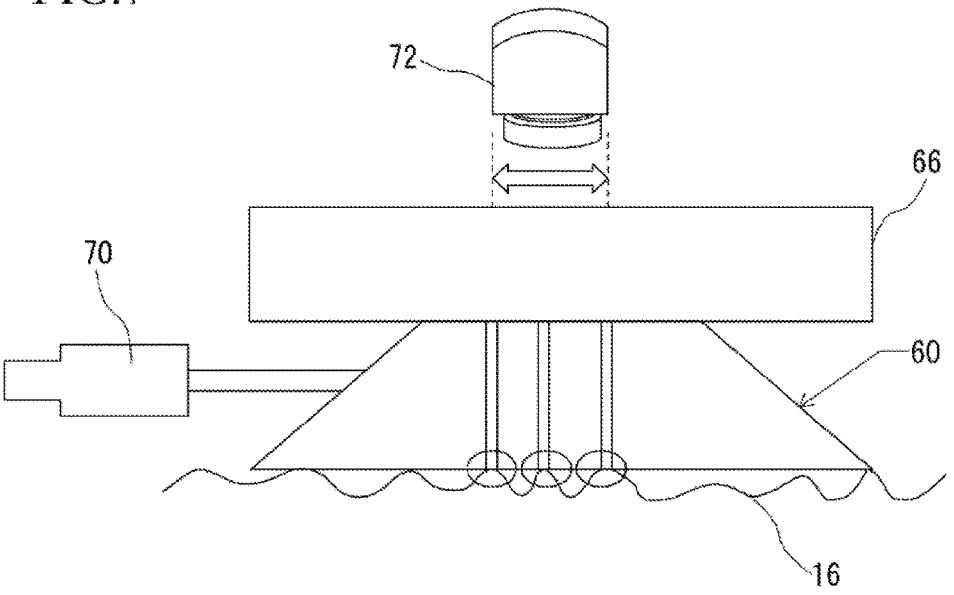
FIG. 7 is an explanation view in which a diffusion reflection light is received by a microscope through the dove prism.
Figure 8A:
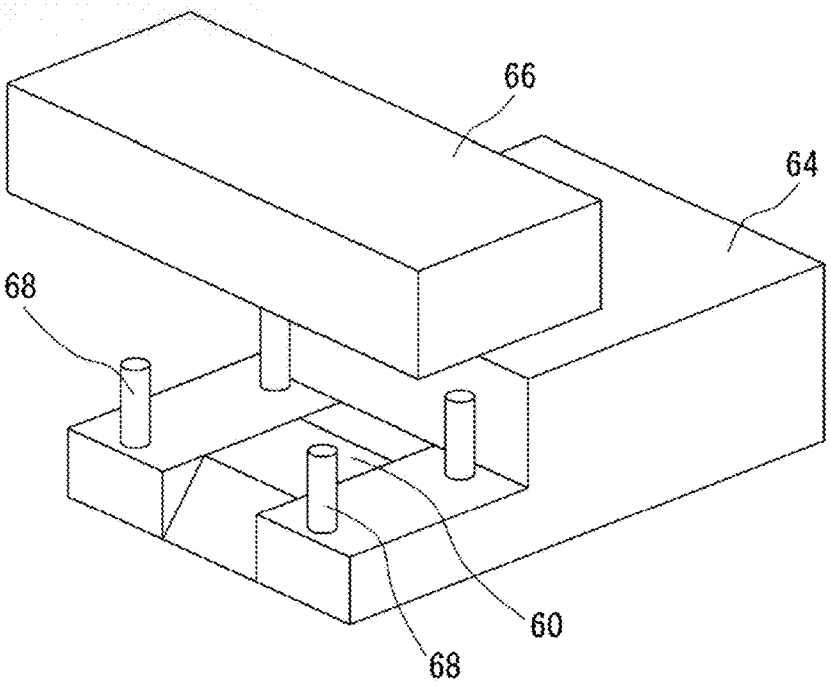
FIGS. 8A and 8B are explanation views of an observation unit.
Figure 8B:
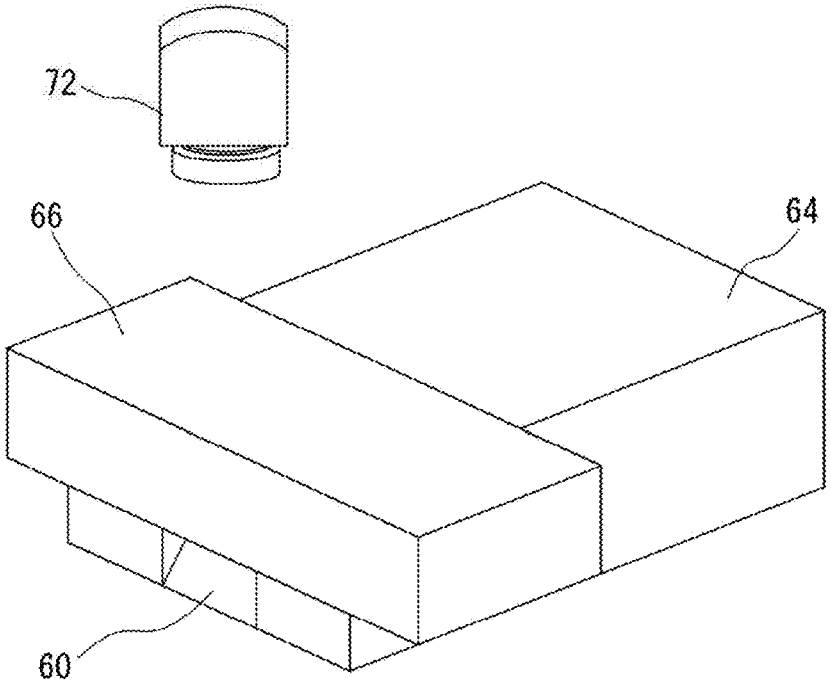

Note that, in the contact image, the contact part is shown white and the noncontacts parts are shown black. In the present embodiment, an observation unit shown in FIGS. 7-8B is used so as to stably apply the prescribed pressing force to the polishing pad 16 through the dove prism 60 and capture the reflection lights exiting from an upper surface (observation surface) 60*c* of the dove prism 60 by the microscope. In FIGS. 7-8B, both side parts of the dove prism 60 are clamped and fixed by a fixing jig 64. A light-transparent weight 66 is mounted on the upper surface (observation surface) 60*c* of the dove prism 60 so as to apply the prescribed pressing force to the polishing pad 16 through the dove prism 60. Positioning holes are formed at prescribed places of the weight 66, and the weight 66 can be mounted on the fixing jig 64 and correctly positioned thereon by inserting pins 68 of the fixing jig 64 into the positioning holes. A symbol 70 stands for a light source, and a symbol 72 stands for the microscope.

Next, the method of Japanese Patent No. 5366041, in which the above described observation unit is used, will be explained.

Namely, claim 1 is a method for observing a surface property of a pad, in which a surface property of a polishing surface of the pad adhered on a polishing plate of a polishing apparatus is observed, comprising the steps of: setting a prism, which has a contact surface, a light incidence surface for making a light enter the contact surface and an observation surface, on the polishing surface of the polishing pad in a state where the contact surface contacts the polishing surface of the pad; applying a prescribed pressing force to the prism, which has been set on the polishing surface, so as to press the polishing surface of the polishing pad by the contact surface; totally reflecting a refracted light on the contact surface corresponding to a recessed part of the polishing pad not in contact with the contact surface, and reflecting a reflection light, which is generated by breaking the total reflection, on the contact surface corresponding to a projected part of the polishing pad in contact with the contact surface, when the light enters the light incidence surface and the refracted light is reflected on the contact surface; receiving the reflection lights exiting from the observation surface of the prism by a light receiving section; and observing a surface condition of the polishing surface on the basis of the received lights, wherein a light-transparent weight is mounted on the prism so as to press the prism, and the reflection light passing through the weight is received by the light receiving section (Invention 1).

Claim 2 is the method for observing a surface property of the pad according to claim 1, wherein the prism is a dove prism (Invention 2).

Claim 3 is the method for observing a surface property of the pad according to claim 1 or 2, wherein a contact image, which is detected by the light receiving section, is binarized in black or white, and the surface property of the polishing pad is measured by using number of contact points per unit area, which is calculated from the binarized image obtained by the binarization process (Invention 3).

Claim 4 is the method for observing a surface property of the pad according to claim 1 or 2, wherein a contact image, which is detected by the light receiving section, is binarized in black or white, and the surface property of the polishing pad is measured by using contact ratio, which is calculated from the binarized image obtained by the binarization process (Invention 4).

Claim 5 is the method for observing a surface property of the pad according to claim 1 or 2, wherein a contact image, which is detected by the light receiving section, is binarized in black or white, and the surface property of the polishing pad is measured by using half-value width of results of spatial FFT analysis, which is calculated from the binarized image obtained by the binarization process (Invention 5).

Details are described in Japanese Patent No. 5366041.

Note that, image diagnosis of the method for observing a surface property of the pad is not limited to the method in which the image binarized by a threshold value. For example, distribution of gray scale values (e.g., gray scale histogram) of the contact image may be used.

Figure 9:
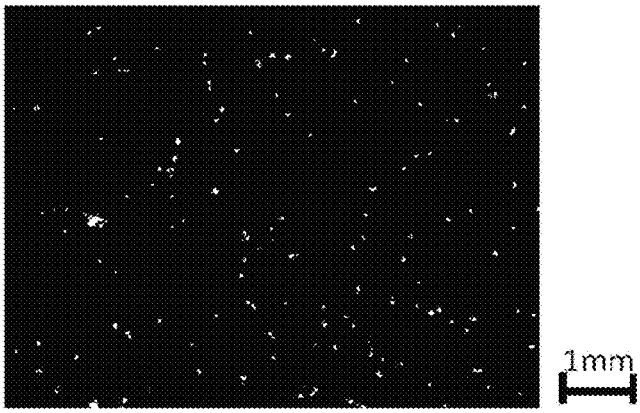
FIG. 9 is a contact image of a polishing pad dressed by a dressing grindstone of #80 and the dove prism, which is measured by a microscope with using the dove prism.
Figure 10:
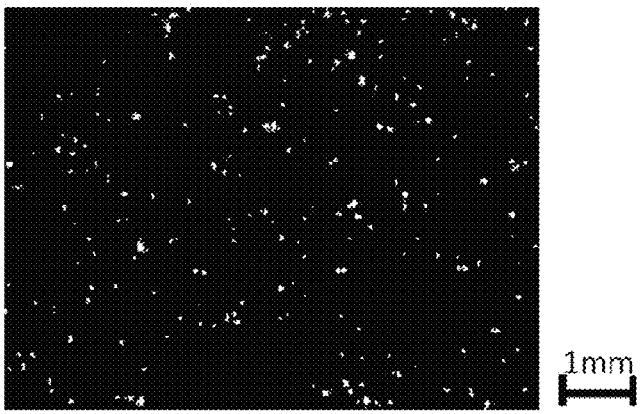
FIG. 10 is a contact image of the polishing pad dressed by a dressing grindstone of #500 and the dove prism, which is measured by the microscope with using the dove prism.
Figure 11:
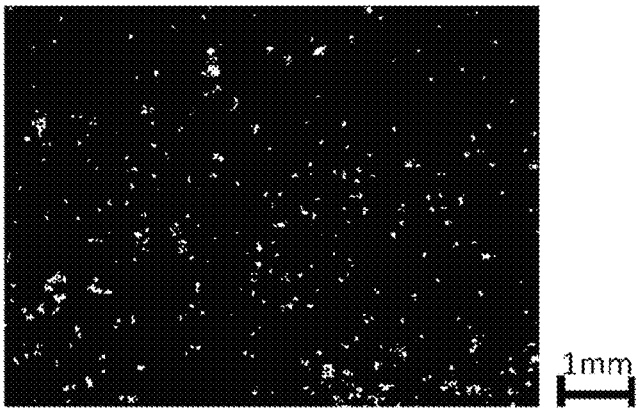
FIG. 11 is a contact image of the polishing pad dressed by a dressing grindstone of #1000 and the dove prism, which is measured by the microscope with using the dove prism.

FIGS. 9-11 are contact images obtained by using the dove prism and the microscope. They are contact images of the dove prism and the polishing pad 16 dressed by the dressing grindstones of #80, #500 and #1000. As clearly shown in FIGS. 9-11, in case of using by the dressing grindstone whose average particle size was small, number of contact points was increased. TABLE 2 shows number of contact points per unit area, which was measured by the method of Invention 3. As clearly shown in TABLEs 1 and 2, in case of polishing the work by the polishing pad 16 which was dressed by the dressing grindstone whose average particle size is smaller, the polishing rate was greater and high polishing efficiency was obtained.

Figure 12:
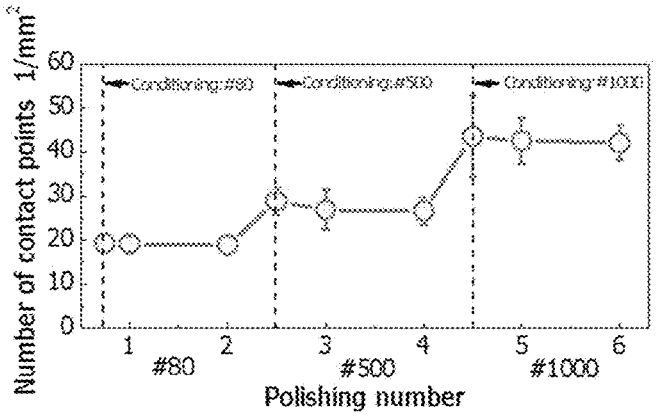
FIG. 12 is a graph showing a relationship between particle sizes of dressing grindstones and measured results of surface properties (number of contact points) of the polishing pad.

FIG. 12 is a graph showing a relationship between particle sizes of the dressing grindstones and measured results of surface properties (number of contact points) of the polishing pad 16. TABLE 3 shows concrete measured values.

TABLE 3

| NUMBER OF TIMES OF DRESSING OR POLISHING | NUMBER OF CONTACT POINTS 1/mm$^2$ |
|---|---|
| # 80 DRESSING | 19.4 |
| POLISHING ONCE | 19.2 |
| POLISHING TWICE | 18.9 |
| # 500 DRESSING | 28.8 |
| POLISHNG THREE TIMES | 27.0 |
| POLISHNG FOUR TIMES | 26.7 |
| # 1000 DRESSING | 43.5 |
| POLISHNG FIVE TIMES | 42.4 |
| POLISHNG SIX TIMES | 42.1 |

In FIG. 12 and TABLE 3, "NUMBER OF CONTACT POINTS 19.4 with respect to #80 DRESSING" means that the number of contact points between the polishing pad 16, which was dressed by the dressing grindstone of #80, and the dove prism was 19.4/mm$^2$. "POLISHING ONCE" means that number of the contact points between the polishing pad 16, which was used to polish the work 20 once, and the dove prism was 19.2/mm$^2$. Further, "POLISHING TWICE" means that number of the contact points between the polishing pad 16, which was used to polish the work 20 twice, and the dove prism was 18.9/mm$^2$.

"#500 DRESSING" means that the polishing pad was further dressed by the dressing grindstone of grit size #500 after being dressed by the dressing grindstone of grit size #80.

"#1000 DRESSING" means that the polishing pad was further dressed by the dressing grindstone of grit size #1000 after being dressed by the dressing grindstones of grit sizes #80 and #500.

In case of using the dressing grindstone whose average particle size was small, the number of contact points was greater than that of the case of using the dressing grindstone whose average particle size was large, and the polishing rate was also greater as described above.

However, in each of the dressing stages, reduction of the number of contact points with increasing the number of times of polishing is not so great. Of course, the number of contact points was reduced with increasing the number of times of polishing. Namely, deterioration of the surface of the polishing pad gradually proceeded, so the number of contact points was reduced.

Figure 13:
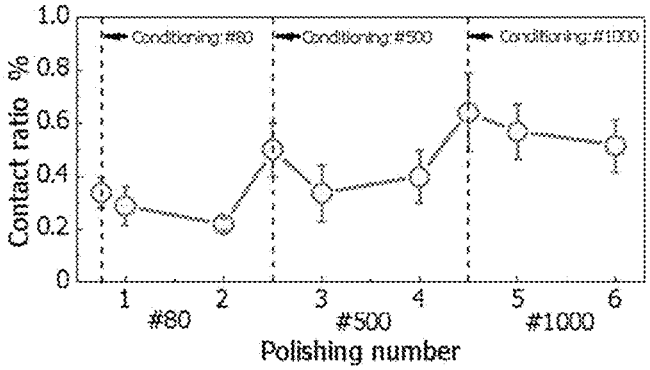
FIG. 13 is a graph showing a relationship between particle sizes of dressing grindstones and measured results of surface properties (contact ratios) of the polishing pad.

FIG. 13 is a graph showing a relationship between particle sizes of dressing grindstones and measured results of surface properties (contact ratios measured by the method of Invention 4) of the polishing pad 16. TABLE 4 shows concrete measured values.

TABLE 4

| NUMBER OF TIMES OF DRESSING OR POLISHING | CONTACT RATIO % |
|---|---|
| # 80 DRESSING | 0.337 |
| POLISHING ONCE | 0.288 |
| POLISHING TWICE | 0.218 |
| # 500 DRESSING | 0.499 |
| POLISHNG THREE TIMES | 0.336 |
| POLISHNG FOUR TIMES | 0.399 |
| # 1000 DRESSING | 0.641 |
| POLISHNG FIVE TIMES | 0.567 |
| POLISHNG SIX TIMES | 0.514 |

As clearly shown in FIG. 13 and TABLE 4, the contact ratios were widely varied, in each of the dressing stages, according to the number of times of polishing. Therefore, it is unfavorable to employ the contact ratios as data indicating the surface properties of the polishing pad 16. This will be a future study.

Note that, the contact ratio means a ratio of "an actual contact area in the obtained contact image (a total area of contact parts observed in the contact image)" to "an apparent contact area (an area of the observed contact image)". An arithmetic section (not shown) calculates the contact ratio by binarizing pixels of the contact image detected by the light receiving section 72 in black or white and calculating a black-white ratio of the binarized image data.

Figure 14:
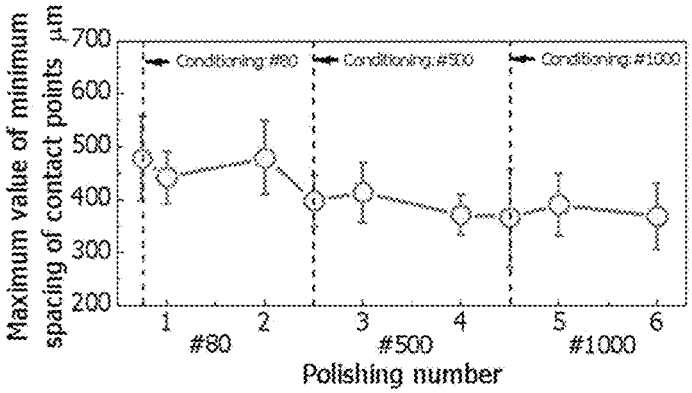
FIG. 14 is a graph showing a relationship between particle sizes of dressing grindstones and measured results of surface properties (spacing of contact points) of the polishing pad.

FIG. 14 is a graph showing a relationship between particle sizes of the dressing grindstones and measured results of the surface properties (spacing of contact points) of the polishing pad 16. TABLE 5 shows concrete measured values.

TABLE 5

| NUMBER OF TIMES OF DRESSING OR POLISHING | SPACING OF CONTACT POINTS μm |
|---|---|
| # 80 DRESSING | 477 |
| POLISHING ONCE | 441 |
| POLISHING TWICE | 479 |
| # 500 DRESSING | 398 |
| POLISHNG THREE TIMES | 414 |
| POLISHNG FOUR TIMES | 371 |
| # 1000 DRESSING | 366 |
| POLISHNG FIVE TIMES | 390 |
| POLISHNG SIX TIMES | 368 |

As shown in FIG. 14 and TABLE 5, the spacing of contact points was widely varied, in each of the dressing stages, according to the number of times of polishing. Therefore, it is unfavorable to employ the spacing of contact points as data indicating the surface properties of the polishing pad 16.

Figure 15:
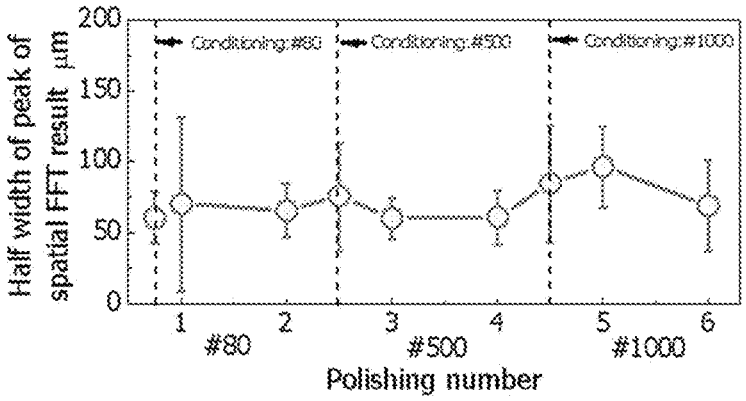
FIG. 15 is a graph showing a relationship between particle sizes of dressing grindstones and measured results of surface properties (spatial FFT analysis) of the polishing pad.

FIG. 15 is a graph showing a relationship between particle sizes of the dressing grindstones and measured results of the surface properties (spatial FFT analysis) of the polishing pad 16. TABLE 6 shows concrete measured values.

TABLE 6

| NUMBER OF TIMES OF DRESSING OR POLISHING | SPATIAL FFT ANALYSIS μm |
|---|---|
| # 80 DRESSING | 60.7 |
| POLISHING ONCE | 70.6 |
| POLISHING TWICE | 66.0 |
| # 500 DRESSING | 75.8 |
| POLISHNG THREE TIMES | 60.5 |
| POLISHNG FOUR TIMES | 61.2 |
| # 1000 DRESSING | 84.8 |
| POLISHNG FIVE TIMES | 96.7 |
| POLISHNG SIX TIMES | 69.4 |

As shown in FIG. 15 and TABLE 6, the spatial FFT analysis was widely varied, in each of the dressing stages, according to the number of times of polishing. Therefore, it is unfavorable to employ the spatial FFT analysis as data indicating the surface properties of the polishing pad 16.

Note that, FFT is an abbreviation of Fast Fourier Transform, which is usually used to know frequency components of fluctuating signals with respect to a time axis. On the other hand, the spatial FFT analysis means an analysis manner for knowing what spatial frequency components are included in an object image. Namely, it can be regarded as one of methods for quantitatively evaluating spaces between the contact points existing in the contact image obtained under different dressing conditions. As an example, in case that the spaces between the contact points are large, it means that the spatial frequency is small. As a result, spectrum obtained from the spatial FFT analysis concentrates to a center frequency (=0), so a half-value width of spectrum wave number becomes small. Therefore, a spatial wavelength, which is an inverse number of the half-value width, becomes large. The arithmetic section calculates the half-value width by binarizing the contact image detected by the light receiving section 72 in black or white and spatial-FFT-analyzing the binarized image data.

As described above, it is favorable to employ the numbers of contact points as data indicating the surface properties of the dressed polishing pad 16. Further, a linear correlation exists between the numbers of contact points and the polishing rates of the dressed polishing pad 16, so it is preferable to use the numbers of contact points as data indicating the surface properties of the dressed polishing pad 16.

Note that, the above described manner for measuring the number of contact points is not a manner for directly measuring the number of contact points between the work 20 and the polishing pad 16. However, in the present embodiment, the numbers of contact points were measured in a state where the dove prism was pressed onto the polishing pad 16 with a prescribed pressing force, so the numbers nearly equal to the actual numbers of contact points between the work 20 and the polishing pad 16 were obtained. Therefore, the measured numbers suitably reflected the states of the work 20 being polished.

In the method disclosed in Patent Document 1 (i.e., Japanese Laid-open Patent Publication No. 2001-260001), the surface property of the polishing pad being dressed is measured by a noncontact manner, so an actual contact state between the work and the polishing plate cannot be known.

As described above, the correlation data, which indicate the correlation between the surface properties of the polishing pad previously dressed under a plurality of stages of the dressing conditions and the polishing effects of the work polished by the polishing pad under a plurality of stages of said dressing conditions, can be obtained.

Figure 16:
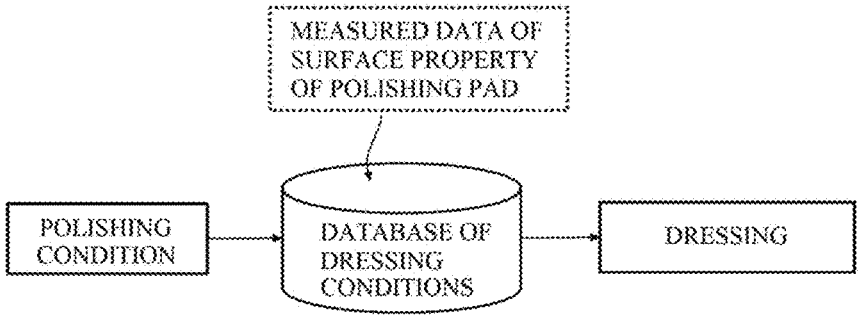
FIG. 16 is an explanation view of previously setting correlation data of polishing conditions, dressing conditions and polishing effects as a database.

As shown in FIG. 16, the obtained correlation data are previously set as a database of the polishing conditions and the dressing conditions (the relationship between the dressing grindstones and the numbers of contact points).

Patent Document 1 (i.e., Japanese Laid-open Patent Publication No. 2001-260001) describes that flat parts are formed by clogging caused by the polishing operation, and contact area proportion is increased. However, in the present embodiment, the number of contact points and the contact ratio are reduced with progressing the polishing. Therefore, as to the number of contact points and the contact ratio, it is supposed that flat parts formed by clogging does not badly influence and that function of easily pressing the surface of the polishing pad 16 against the work 20 (e.g., function of a flexibility of the polishing pad 16, which biases the polishing pad 16 toward the work 20 and brings the same into contact with the work 20 when the surface of the polishing pad 16 is pressed onto the work 20) is weakened.

Namely, the surface property described in Patent Document 1 is flatness of the polishing pad while polishing the work, and the data of flatness are different from the data of the surface property (i.e., the number of contact points and the contact ratio) of the present embodiment. In the present embodiment, if the data of surface property described in Patent Document 1 are used, it is difficult to execute the methods relating to the present invention.

Figure 17:
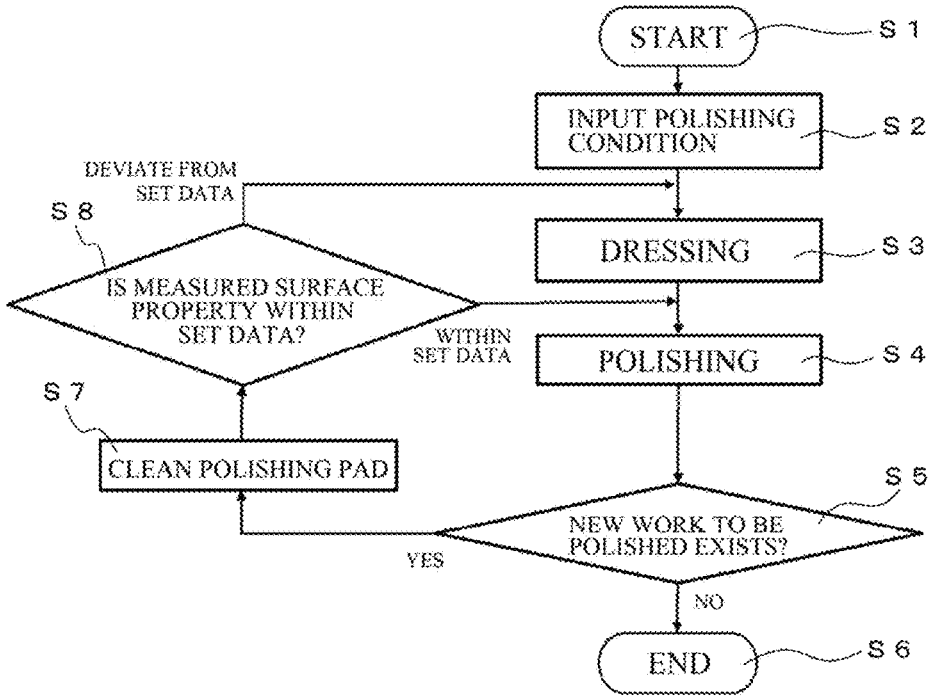
FIG. 17 is a flow chart of dressing the polishing pad and polishing a work.

Next, the step of polishing the work 20 will be explained. FIG. 17 is a flow chart of dressing the polishing pad and polishing the work 20. Firstly, a start switch (not shown) of the polishing apparatus is pushed to start (Step S1).

<Step (B) of Dressing Polishing Pad>

Next, polishing conditions are inputted (Step S2). For example, a material of the work to be polished (e.g., sapphire), a size of the work, and a polishing load (e.g., low load of 30 kPa) are inputted. Further, an object polishing rate (e.g., 5.0) is also inputted.

When the polishing conditions including the object polishing rate are inputted, an assumed dressing condition capable of achieving an object polishing effect (e.g., 5.0) is determined from the correlation data. For example, "#1000 DRESSING" is selected from the correlation data of TABLEs 1 and 2 as the assumed dressing condition because the corresponding polishing rate, i.e., 5.28, is close to the object polishing effect.

The polishing pad 16 is dressed under the determined assumed dressing condition prior to the step of polishing the work 20 (Step S3).

By performing this dressing step, it is assumed that the surface property (number of contact points) of the polishing pad 16 is 43.5.

<Step (C) of Polishing Work>

After dressing the polishing pad 16, the work 20 is polished (Step S4).

If no work to be polished exists after polishing the work 20 (Step S5), the polishing is completed (Step S6).

<Step (D) of Cleaning Polishing Pad>

If another work to be continuously polished exists (Step S5), the polishing pad 16 is cleaned (Step S7).

<Step (E) of Measuring Surface Property>

Next, the surface property (i.e., number of contact points) of the cleaned polishing pad 16 is measured by the manner described above (Step S8).

<Step (F) of Redressing>

If the measured surface property (number of contact points) is equal to or more than a set value (e.g., 41.3 determined with considering measurement errors and deterioration of 5% caused by exhaustion), the measured surface property is within the set data, the polishing pad 16 is continuously used to polish next work (Step S4). If the measured surface property is inferior to the set value, the polishing pad 16 is redressed under the assumed dressing condition (Step S3), and then the work 20 is polished (Step S4).

Note that, in case that the surface property of the polishing pad 16 is not recovered by dressing the polishing pad 16 again after redressing the polishing pad 16 under the assumed dressing condition, cleaning the polishing pad 16, and measuring the surface property thereof, it is preferable to exchange the polishing pad.

By increasing number of conditions in each of stages of the dressing conditions, the correlation data can be made dense, so that highly precise correlation data can be obtained. Thus, number of the stages (number of kinds of the dressing grindstones) may be increased, or new conditions (e.g., pressing time of the dressing head, pressing force thereof) may be added.

Further, lacking parts of the correlation data may be complemented by an approximate expression calculated from the correlation data.

Figure 18:
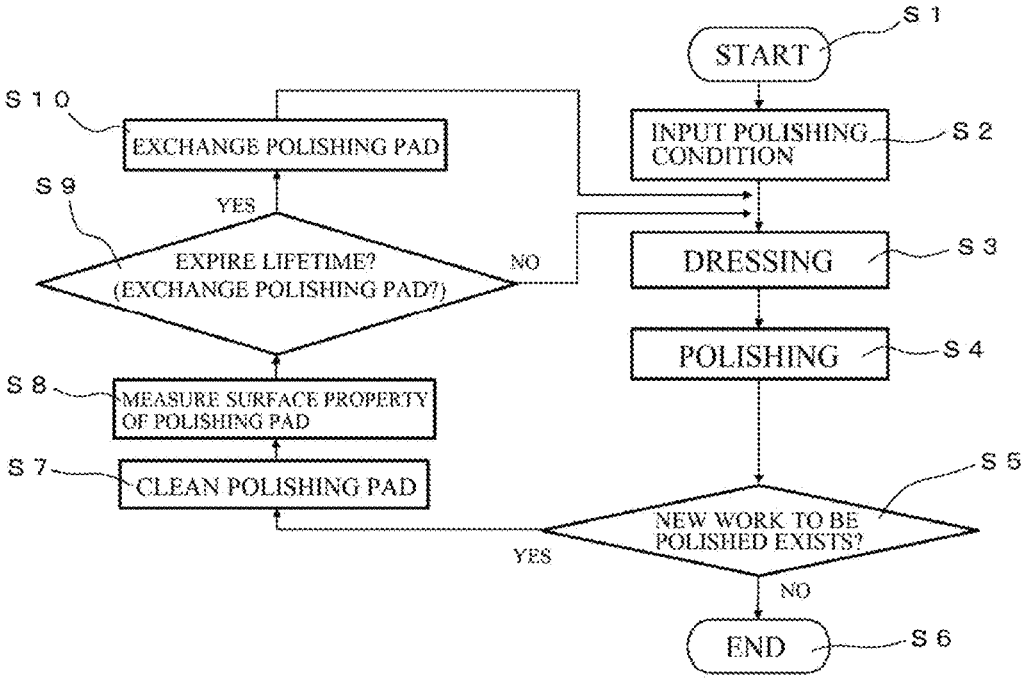
FIG. 18 is another flow chart of exchanging the polishing pad.

FIG. 18 is another flow chart of exchanging the polishing pad 16.

After measuring the surface property (number of contact points) of the polishing pad 16 in Step S8, life determination of the polishing pad 16 is performed (Step S9). For example, in case that the life determination is performed on the basis of number of times of polishing the work 20, if the number of times of polishing the work 20 is more than a predetermined number, the polishing pad 16 is determined to have expiration of its lifetime and exchanged to new one (Step S10). In case that the polishing pad 16 has been exchanged, the new polishing pad 16 is dressed under the assumed dressing condition (Step S3), and then the work 20 is polished by the polishing pad 16 (Step S4). In case that the number of times of polishing the work 20 is less than the predetermined number, the polishing pad 16 is dressed (Step S3) and polishing the work 20 is continued (Step S5).

Polishing the work 20 and dressing the polishing pad 16 can be performed as described above.

The present embodiment is performed by the steps of: previously obtaining the correlation data between the surface properties of the polishing pad 16 dressed under a plurality of stages of the dressing conditions and the polishing effects of the work 20 polished by the polishing pad 16 dressed under the dressing conditions; determining the assumed dressing condition capable of achieving the object polishing effect from the correlation data; dressing the polishing pad 16 under the assumed dressing condition determined; polishing the work 20 after performing the dressing step; cleaning the polishing pad which has been used for polishing the work 20 after performing the polishing step; and measuring the surface property of the cleaned polishing pad 16 after performing the cleaning step, so that the surface property of the polishing pad 16 can be correctly detected without being badly influenced by polishing dusts, etc., and high accurate dressing can be performed. Further, since the surface property of the polishing pad 16 is controlled within the set data indicating the predetermined surface property, the work 20 can be accurately polished.

A polishing state of the work 20 is controlled on the basis of the surface property of the polishing pad 16, which can be easily measured, without using polishing rate of the work 20, so that the polishing can be easily controlled.

By obtaining the correlation data as a plurality of stages of combination data of the dressing conditions and the polishing conditions, actual dressing conditions and polishing conditions can be precisely determined, so that the surface property of the polishing pad 16 can be excellently maintained. Therefore, the work 20 can be precisely polished.

In case that the surface property of the polishing pad 16 is indicated as the number of the contact points between the dove prism and the polishing pad 16 in the state where the dove prism is pressed onto the polishing pad 16 with the prescribed pressing force, the number of the contact points between the work 20 and the polishing pad 16 is not directly measured, but the number of the contact points nearly equal to the directly measured number can be obtained, so that the state of the work 20 being polished can be suitably obtained.

Note that, in the above described embodiment, the surface property of the polishing pad 16 is indicated by the number of the contact points. Further, the surface property may be indicated by inclination (flatness) of the surface from the center part of the polishing pad 16 to the outer edge part thereof.

By swinging the dressing head 30 between the center part of the polishing pad 16 and the outer edge part thereof at a fixed speed, an amount of dressing the center part is usually greater that of dressing the outer edge part due to a contact length between the dressing grindstone and the polishing pad 16, so a surface shape (surface property) of the polishing pad 16 is formed into a mortar shape.

Controlling the surface property of the polishing pad 16 depends on dressing conditions, e.g., swing speed of the swing arm 28 (fixed speed or nonfixed speed), rotational speed of the dressing head 30, pressing force of the dressing head 30 applied to the polishing pad 16, rotational speed of the polishing plate 12.

Further, the pressing force of the dressing head 30 applied to the outer edge part of the polishing pad 16 is varied according to an amount of offsetting the dressing head 30 (dressing grindstones) in the outer edge part of the polishing pad 16 (an amount of outwardly projecting the swung dressing head 30 from the outer edge of the polishing pad 16), so a surface shape of the outer edge part of the polishing pad 16 is varied.

Controlling the surface property (surface shape) may be performed by a method disclosed in Japanese Patent No. 4358763.

In this case too, polishing the work 20 and dressing the polishing pad 16 can be suitably performed by previously obtaining the correlation data between the surface properties (surface shapes) of the polishing pad 16 dressed under a plurality of stages of the dressing conditions and the polishing effects of the work 20 polished by the polishing pad 16 dressed under the dressing conditions of the stages.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alternations could be made hereto without departing from the spirit and scope of the invention.

What is claimed is:

1. A method of polishing a work, comprising the steps of:

obtaining previous correlation data between surface properties of a polishing pad dressed, by a dressing grindstone, under a plurality of stages of dressing conditions and polishing effects of the work polished by the polishing pad dressed under the dressing conditions;

determining an assumed dressing condition capable of achieving an object polishing effect from the correlation data;

supplying a new polishing pad;

dressing the new polishing pad, by the dressing grindstone, under the assumed dressing condition determined;

pressing a work onto the new polishing pad of a rotating polishing plate, and polishing a surface of the work with supplying a polishing liquid to the new polishing pad;

cleaning the new polishing pad which has been used for polishing the work; and measuring a surface property of the cleaned new polishing pad, wherein if the measured surface property of the new polishing pad is within set data, which have been set by using the correlation data, a new step of polishing the work is performed, if the measured surface property of the new polishing pad is inferior to the set data, the step of dressing the polishing pad under the assumed dressing condition is performed again or the new polishing pad is exchanged, and wherein the surface property of the polishing pad is measured by the steps of:

i. setting a prism, which has a contact surface, a light incidence surface for making a light enter the contact surface and an observation surface, on the polishing surface of the polishing pad in a state where the contact surface contacts the polishing surface;

ii. applying a prescribed pressing force to the prism, which has been set on the polishing surface, so as to press the polishing surface of the polishing pad by the contact surface;

iii. totally reflecting a refracted light on the contact surface corresponding to a recessed part of the polishing pad not in contact with the contact surface, and reflecting a reflection light, which is generated by breaking the total reflection, on the contact surface corresponding to a projected part of the polishing pad in contact with the contact surface, when the light enters the light incidence surface and the refracted light is reflected on the contact surface;

iv. receiving the reflection lights exiting from the observation surface of the prism by a light receiving section;

v. observing a surface condition of the polishing surface on the basis of the received lights;

vi. binarizing a contact image, which is detected by the light receiving section, in black or white; and vii. measuring the surface property of the polishing pad by using number of contact points per unit area, which is calculated from the binarized image obtained by the binarization process.

2. The method of polishing a work, comprising the steps of:

obtaining previous correlation data between surface properties of a polishing pad dressed, by a dressing grindstone, under a plurality of stages of dressing conditions and polishing effects of the work polished by the polishing pad dressed under the dressing conditions;

determining an assumed dressing condition capable of achieving an object polishing effect from the correlation data;

supplying a new polishing pad is used;

dressing a new polishing pad, by the dressing grindstone, under the assumed dressing condition determined, and pressing a work onto the new polishing pad of a rotating polishing plate;

polishing a surface of the work with supplying a polishing liquid to the new polishing pad;

cleaning the new polishing pad which has been used for polishing the work; and measuring a surface property of the cleaned new polishing pad, wherein the surface property of the polishing pad is measured by the steps of:

i. setting a prism, which has a contact surface, a light incidence surface for making a light enter the contact surface and an observation surface, on the polishing surface of the polishing pad in a state where the contact surface contacts the polishing surface;

ii. applying a prescribed pressing force to the prism, which has been set on the polishing surface, so as to press the polishing surface of the polishing pad by the contact surface;

iii. totally reflecting a refracted light on the contact surface corresponding to a recessed part of the polishing pad not in contact with the contact surface, and reflecting a reflection light, which is generated by breaking the total reflection, on the contact surface corresponding to a projected part of the polishing pad in contact with the contact surface, when the light enters the light incidence surface and the refracted light is reflected on the contact surface;

iv. receiving the reflection lights exiting from the observation surface of the prism by a light receiving section;

v. observing a surface condition of the polishing surface on the basis of the received lights, and wherein if the measured surface property of the new polishing pad is within set data, which have been set by using the correlation data, a new step of polishing the work is performed; and wherein if the measured surface property of the new polishing pad is inferior to the set data, the step of dressing the polishing pad under the assumed dressing condition is performed again or the new polishing pad is exchanged.

3. The method according to claim 2, dressing under the plurality of stages of the pressing conditions and polishing the work under a plurality of polishing conditions, in which the work is pressed onto the new polishing pad with different polishing pressures, are performed when the correlation data are obtained.

4. The method according to claim 2, wherein the prism is a dove prism.

5. The method according to claim 2, wherein a contact image, which is detected by the light receiving section, is binarized in black or white, and the surface property of the polishing pad is measured by using number of contact points per unit area, which is calculated from the binarized image obtained by the binarization process.

6. The method according to claim 2, wherein the polishing effect of the work is due to a rate of polishing the work.

* * * * *